US006840575B2

(12) United States Patent
Hesse

(10) Patent No.: US 6,840,575 B2
(45) Date of Patent: Jan. 11, 2005

(54) SEAT-RECLINER FITTING THAT CAN BE ADJUSTED BY A MOTOR

(75) Inventor: Detlef Hesse, Verl (DE)

(73) Assignee: Dewert Antriebs-und Systemtechnik GmbH & Co. KG, Kirchlengern (DE)

( * ) Notice: Subject to any disclaimer, the term of this patent is extended or adjusted under 35 U.S.C. 154(b) by 31 days.

(21) Appl. No.: 10/363,647

(22) PCT Filed: Apr. 12, 2002

(86) PCT No.: PCT/EP02/04103

§ 371 (c)(1),
(2), (4) Date: Mar. 4, 2003

(87) PCT Pub. No.: WO02/087389

PCT Pub. Date: Nov. 7, 2002

(65) Prior Publication Data

US 2004/0012231 A1 Jan. 22, 2004

(30) Foreign Application Priority Data

Apr. 14, 2001 (DE) ..... 201 06 560 U

(51) Int. Cl.[7] ..... A47C 1/02
(52) U.S. Cl. ..... 297/85; 297/75
(58) Field of Search ..... 297/70, 75, 76, 297/84, 85, 423.28, 423.34, 423.35, 423.36

(56) References Cited

U.S. PATENT DOCUMENTS

| | | | | | |
|---|---|---|---|---|---|
| 3,016,264 | A | * | 1/1962 | Hughes | 297/69 |
| 3,743,348 | A | | 7/1973 | Sloan | |
| 4,007,960 | A | | 2/1977 | Gaffney | |
| 4,365,836 | A | | 12/1982 | Jackson et al. | |
| 4,674,794 | A | * | 6/1987 | Pine | 297/85 |
| 5,013,084 | A | * | 5/1991 | May | 297/85 |
| 5,354,116 | A | | 10/1994 | May et al. | |
| 5,582,457 | A | * | 12/1996 | Komorowski et al. | 297/75 |
| 5,845,961 | A | * | 12/1998 | LaPointe et al. | 297/75 |
| 6,142,558 | A | * | 11/2000 | May | 297/75 |

FOREIGN PATENT DOCUMENTS

DE 94 20 149.8 2/1995

* cited by examiner

*Primary Examiner*—Peter M. Cuomo
*Assistant Examiner*—Stephen Vu
(74) *Attorney, Agent, or Firm*—Browdy and Neimark, P.L.L.C.

(57) ABSTRACT

A seat-recliner fitting is provided for the motor-driven inclination adjustment of a backrest (1) and for the motor-driven folding out and folding in of a two-part leg support (3A, 3B), whereby the fitting is completely pre-installed at the factory between two lateral plates (4), which are connected to cross-members (40, 41) and to which each lateral wall (42) provided with an arm rest is attached.

21 Claims, 11 Drawing Sheets

1
10
12
20A
20A
42
24
2
41
42
4
11
31
22
4
33
20
13
40
34A
35
32
34
I
38
30A
37
36
3B
3A
30B
I

Fig. 10
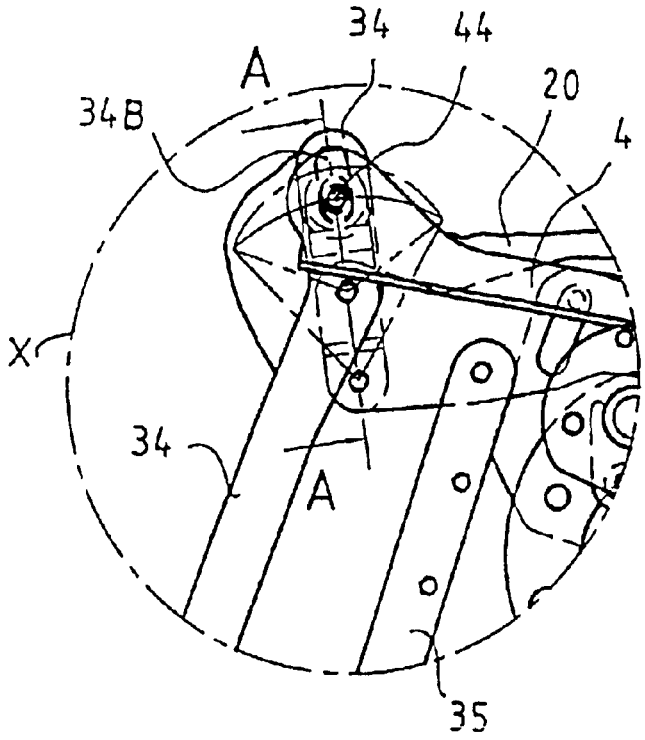
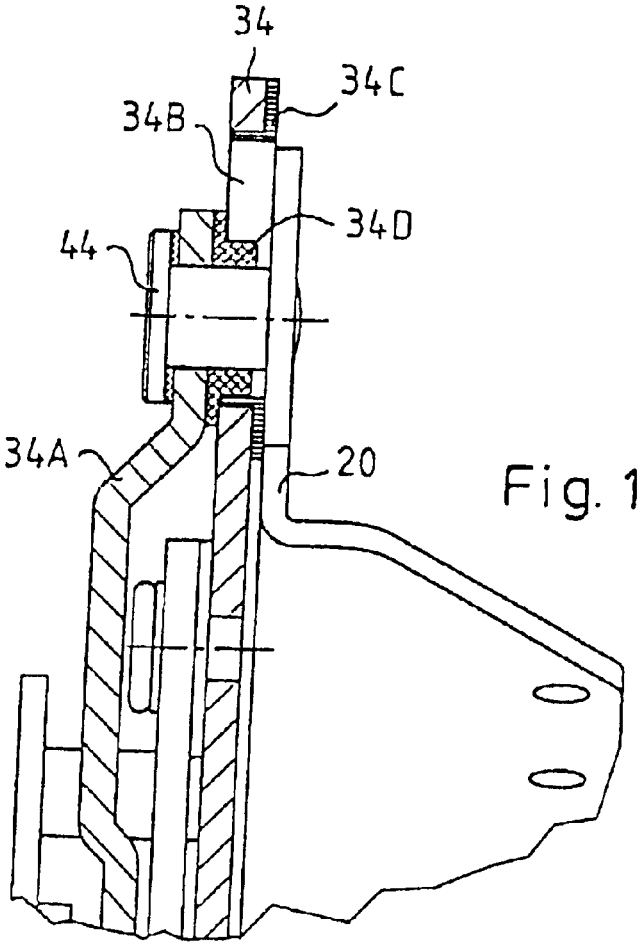
Fig. 11

SEAT-RECLINER FITTING THAT CAN BE ADJUSTED BY A MOTOR

BACKGROUND OF THE INVENTION

The present invention is concerned with a seat recliner fitting for the motor-driven inclination adjustment of a backrest and for the motor-driven folding out and folding in of a two-part leg support.

Known fittings of this type consists of a multitude of individual elements and assemblies that must be installed into a recliner frame and to the armrest, backrest, seat and leg support elements, as well as to one another.

SUMMARY OF THE INVENTION

It is the object of the present invention to create a substantially simpler furniture fitting that is exceedingly simple to install on the furniture elements.

This object is met in such a way that the fitting is completely pre-installed at the factory between two lateral plates, which are connected to cross-members and to which each side panel provided with an arm rest is attached, that each lateral plate has seat fitting linkage arms directly or indirectly linked to it, to which a mounting angle is linked to attach a seat frame along the length of which it approximately extends, and the leg support components are linked by means of scissor-type linkages directly or indirectly as support fitting linkage arms, which carry the leg supports on the respective angle pieces and a mounting plate to hold a backrest frame is directly or indirectly linked to the mounting angle, and that a backrest cross bar is disposed between the mounting plates on both sides, and a seat cross bar is disposed between the mounting angles on both sides, and a drive member of a backrest adjusting motor extends between this seat cross bar and the backrest cross bar, and that a scissor-type cross bar extends between the two scissor-type linkages, with a drive member for a leg support drive motor extending between this scissor-type cross bar and one of the cross-members, or that the drive member for the leg support motor extends between a cross-member and a cross bar that is disposed between the mounting angles.

Advantageous embodiments will be specified in the subclaims.

The skeletal structure that supports the entire linkage and drive means and also carries the backrest, seat, and supporting elements to be mounted thereon, consists of the two outer lateral plates to which the side parts with the arm rests are to be attached, and of the interposed cross-members that are rigidly connected to the former. The linkage arms are made of flat steel, partly shaped with an offset bend to the extent that a narrow clearance is required and disposed near the plates, and the mounting angles and angle pieces extend inward with their assembly legs to receive the seat frame or the plate-shaped leg supports. The skeletal structure also incorporates the drive means with the motors.

The drive forces are transferred from the motors via cross bars to the given fitting pieces that are symmetrically disposed on both sides and movable, either directly or indirectly, by means of cross bars. The drive means are provided preferably in the form of spindle motors, which can be connected very easily.

The entire skeletal structure is held at its lateral plates in supporting side panels, which carry the arm rests and side padding. A separate base frame for the piece of furniture can be eliminated, as all remaining furniture elements, i.e., the backrest, seat and leg support plates are held on and fastened to the skeletal structure. The lateral stability of the piece of furniture, in addition to the cross-members, also results from the cross bars and from the furniture elements that extend from side fitting to side fitting and which are screwed on with rigid angles.

The cross-members and bars are preferably made of tubing that is inserted into matching cutouts and connected therein releasable or rigidly, e.g., by welding.

Owing to a suitable execution of the scissor-type linkage arms and a linking of the leg support closest to the seat to the lower front scissor-type linkage section on one hand, and via an auxiliary linkage to the lower scissor-type linkage section closest to the seat on the other hand, the two leg supports are situated to one another in such a way that the leg supports in their extended position are situated in one plane behind one another and in their retracted position approximately vertically behind one another, with the inner support plate extending between the scissor-type linkages and the wider outer support plate closing off the front face below the seat. The support plates may be covered with suitable padding or upholstery fabric, so that they are an integral component of the visual seat design.

An advantageous wide overhang of the leg supports is attained by long scissor-type linkage members that are directly or indirectly linked to the lateral plates closely underneath the seat and that extend close to the floor when they are being pivoted. The total pivoting angle of the inner scissor-type linkage arms is approximately 145°. They are situated in one and the same plane of the scissor-type linkage mechanism so that low moments of force occur in the support points. The front linkage arms of the scissor-type linkage mechanism are each located to both sides of the rear linkage arms and to both sides of the associated connecting leg of the angle piece, which closes off the scissor-type linkage mechanism. One of the front scissor-type linkage arms, preferably the outer one, is designed wide enough so that it always overlaps the other one at least to a certain degree so that there is no danger of a person's fingers or the like getting caught during a readjustment of the scissor-type linkage mechanism. This wide design of the scissor-type linkage arm additionally also provides a high degree of stability to support the weight when the leg support is extended.

Each of the seat mounting angles is linked directly or indirectly to the lateral plate by means of a short seat fitting linkage arm in the front and a longer one in the rear. These seat linkage arms extend upward. The front linkage arm is connected to a leg support fitting linkage arm and is adjusted together with the same by means of the leg support adjusting drive. The seat is accordingly coupled to the leg supports in such a way that the seat linkage arms are positioned nearly parallel when the leg supports are extended and slanted forward when the leg supports are retracted, so that the seat is lowered more in the front in this position and remains essentially at an unchanged height in the back during any adjustment. Since the backrest is linked to the seat mounting angle in the rear area and the backrest adjusting drive is situated between the seat and the backrest, the respective given backrest position relative to the seat remains unaffected by any adjustment of the leg support, which displaces the seat and backrest together approximately horizontally.

In a first embodiment the mounting angle of the seat and the mounting plate of the backrest are connected to one another in articulated fashion at a mounting angle extension, which is disposed at approximately half the height of the seat and backrest between the same, close to the backrest padding. As a result the two padding elements lie close against one another in the sitting position and move apart in the reclined position only by a measure corresponding to half of the padding thickness. The hinges and mounting components that are installed laterally close to the padding elements are sufficiently recessed downward in the gap in order not to have any interfering effect.

In a second embodiment, the mounting angle and the mounting plate are connected in each case to a scissor-type backrest linkage, the linkage arm of which is designed and linked in such a way that the backrest padding and seat padding always touch in the upper region when the backrest is being readjusted and no gap occurs between them. To connect the lower linkage arm closest to the seat, the seat mounting angle has a downward facing extension. The upper scissor-type linkage arm closest to the seat is connected close to the lower rear end of the seat above the other scissor-type linkage arm.

In a further improvement of the second embodiment, the scissor-type backrest linkages are implemented as a multi-part scissor-type linkage, thus permitting advantageous adaptations of the movements to different types of padding. This permits, in a particularly advantageous fashion, the contact of the backrest and seat padding with one another along the entire adjustment range of the backrest almost completely without the padding elements sliding on one another, thus preventing increased wear and tear in the contact areas.

In a third embodiment, the leg supports are adjusted via the movement of the seat frame and the motor is fastened on a cross-member and its adjusting spindle moves the seat frame back and forth via a pivoting lever that engages in the rear seat frame area. The coupling of the seat frame in the front region to the leg support fitting linkage arms accordingly permits the adjustment of the leg supports. In this advantageous system the cross bar between the leg support linkage arms is eliminated and permits a larger degree of freedom in this area.

Advantageous embodiments are presented in FIGS. 1–8:

BRIEF DESCRIPTION OF THE DRAWINGS

FIG. 10 shows a linkage variant between the seat frame and leg support fitting linkage in a section enlargement of the area X of FIG. 9;

FIG. 11 shows a view A—A according to FIG. 10 in a section;

DETAILED DESCRIPTION

Figure 1:
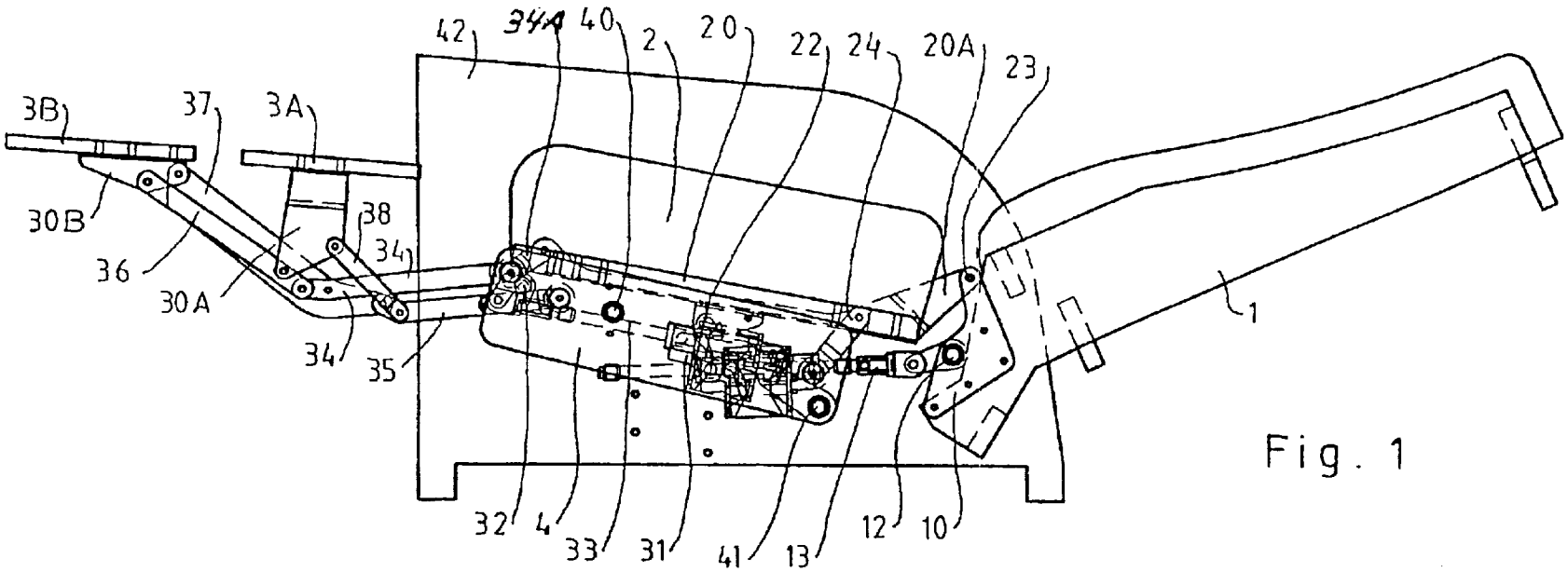
FIG. 1 shows a side view of a chair in the reclined position with the side panel removed, partly in the view I—I.
Figure 2:
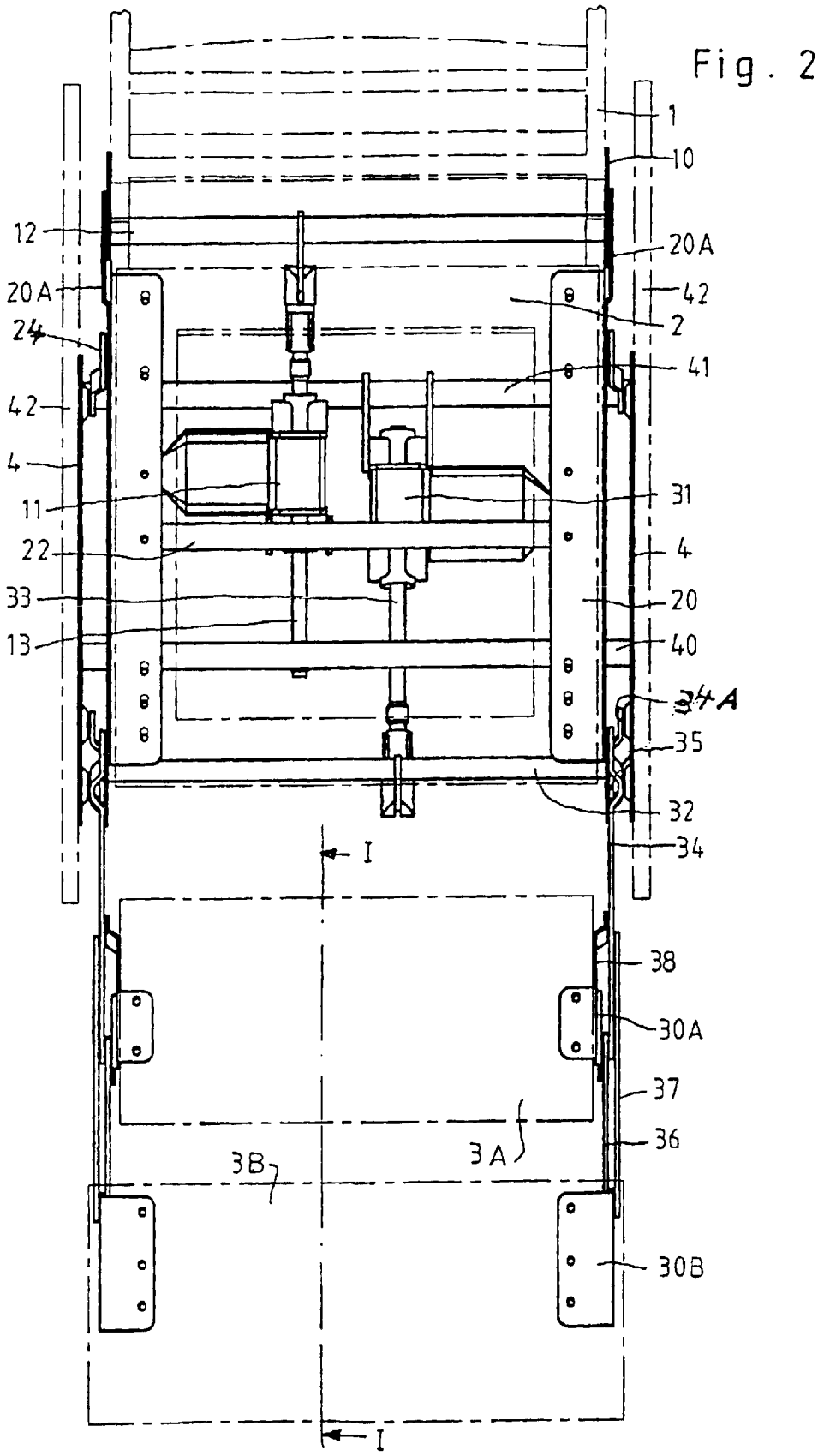
FIG. 2 is an assembled longitudinal view of a fuel injector according to an embodiment of the present invention, showing a sectional view upon the injection.

FIG. 1 shows a chair in a reclined position in a side view, which has one side panel removed and whose side panel 42, shown in the back of the figure has a complete sub-assembly screwed to it that consists of symmetrical fitting assemblies, which are congruent in the figure and each of which is held on a lateral plate 4 of which the one that is located covered in the back of the figure is screwed to the side panel 42. Since the lateral fitting assemblies are symmetrical, identical reference numerals will be used throughout for matching pieces. Extending between the lateral plates 4 are sturdy cross-members 40, 41, as shown in FIG. 2, which are designed tubular, welded into matching plate recesses, or otherwise connected removable or rigidly.

In the front and rear area of the plate 4 a seat fitting linkage 24, 34A is connected in each case, to the other end of which a mounting angle 20 is linked in each case, to the inwardly pointing leg of which a seat frame of a seat is screwed. The mounting angle 20 is connected to its laterally reversed counterpart by means of a sturdy seat cross bar 22.

On the rear, a mounting angle extension 20A extends from the mounting angle 20 upward to approximately half the height of the seat padding, with a fitting plate linked to the mounting angle extension 20A as a mounting plate 10 for the backrest 1 or for a backrest frame, to which it is laterally screwed in multiple locations. Said backrest linkage joint 23 on the mounting plate 10 is located some distance below the surface of the backrest padding. Below this backrest linkage joint 23 a backrest cross bar 12 is disposed, extending from mounting plate 10 to mounting plate.

On this backrest cross bar 12 and on the seat cross bar 22, a backrest adjusting motor is linked by means of a drive member 13, preferably a spindle.

Figure 3:
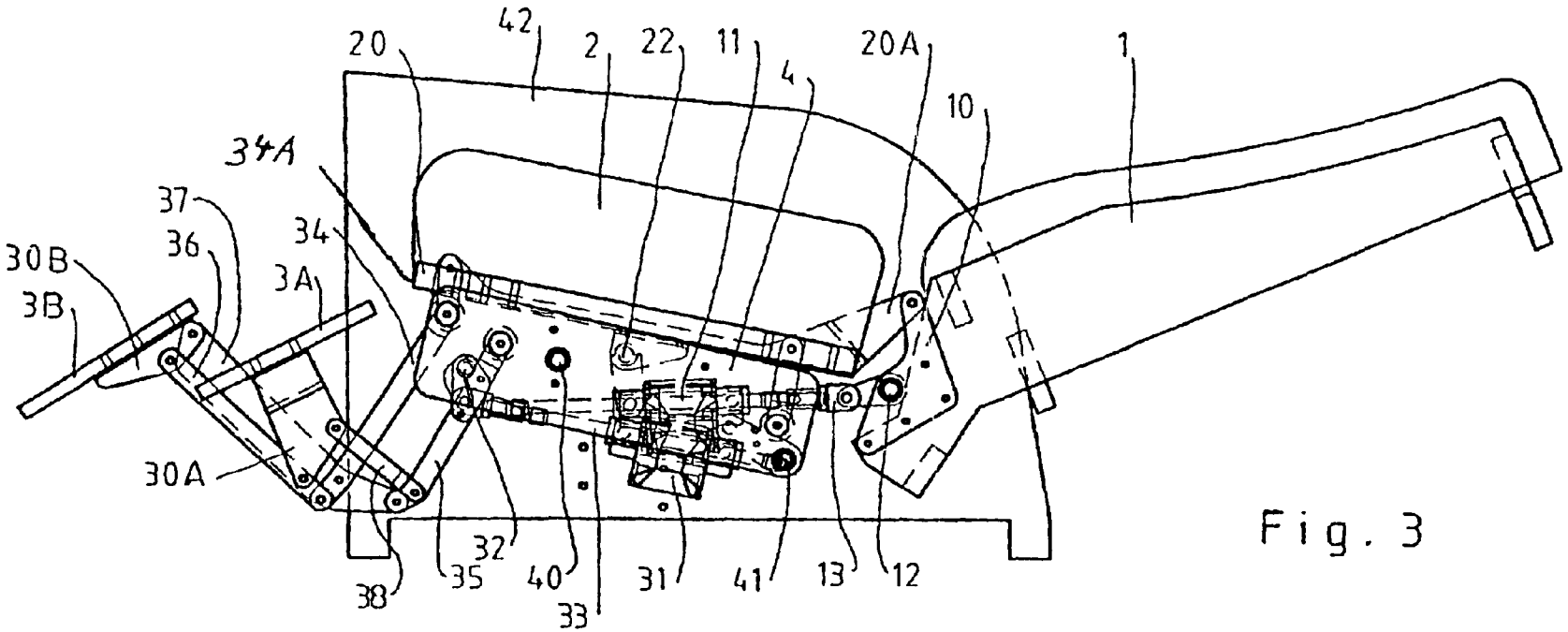
FIG. 3 is a top view showing another support portion of a cylindrical member.
Figure 4:
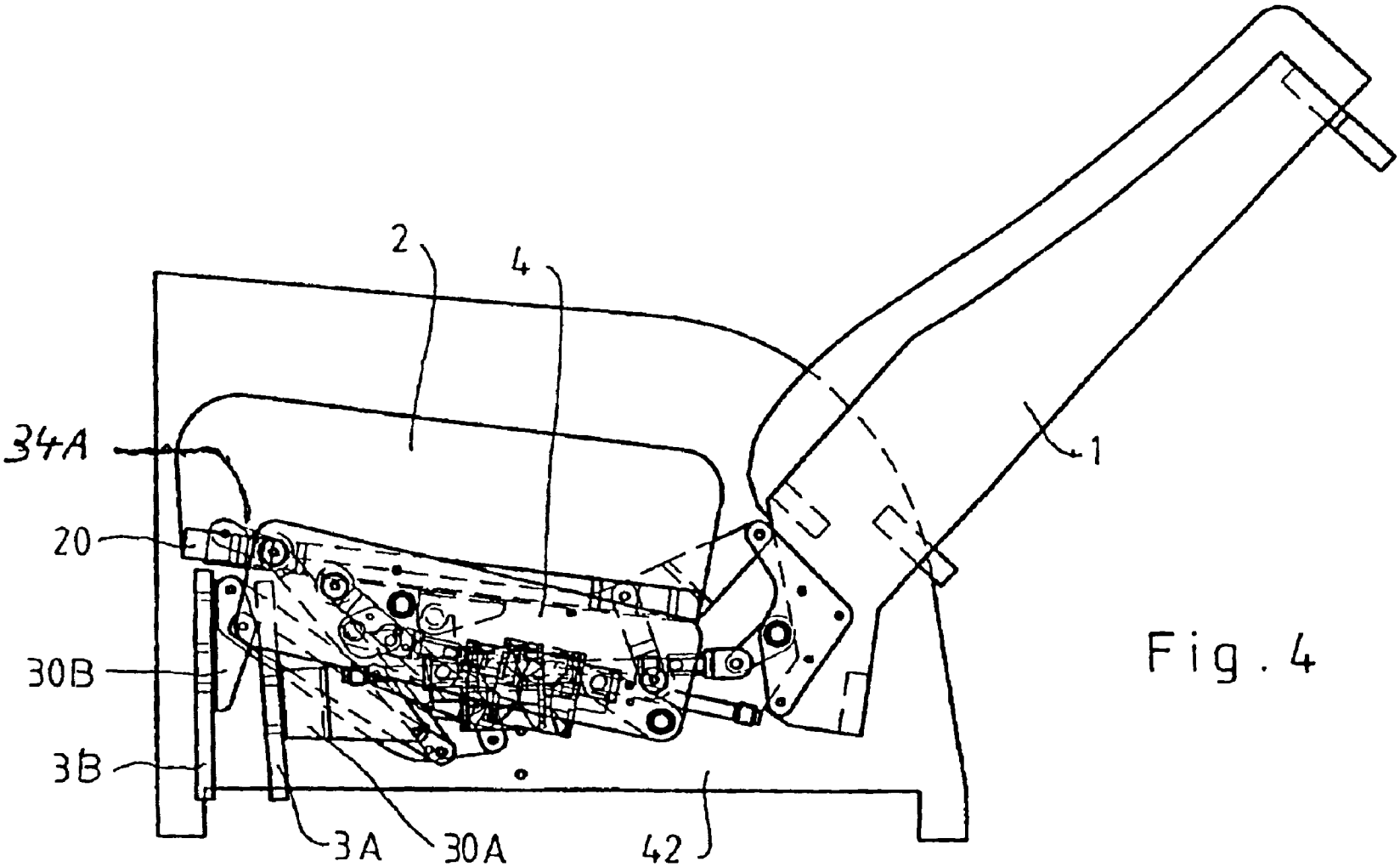
FIG. 4 is an assembled longitudinal view of a portion of a fuel injector according to an alternative embodiment of the present invention, showing the second and third cylindrical members of the embodiment depicted in FIG. 1 formed as one pierce.

When the adjusting spindle 13 pushes the bars 12, 22 apart, the seat 2 is pushed forward on the seat mounting angle 20 while being supported on the short front linkage arm 34A. When the bars 12, 22 are pushed apart, the backrest 1 is swiveled upward with the mounting plate 10, as shown in various phases in FIGS. 3 and 4. In the swiveled-up seat position the seat padding and backrest padding sit closely against one another. The front seat linkage arm 34A extends beyond its plate joint into the upper scissor-type linkage arm 34 of the support fitting linkages closest to the seat and is adjusted together with its drive.

In the resting position shown in FIG. 1, the backrest 1 is tilted back slightly rising and the seat padding 2 is slightly tilted back and displaced by a hand's width toward the backrest 1, however, a gap of a few centimeters width remains between the two padding elements.

Figure 5:
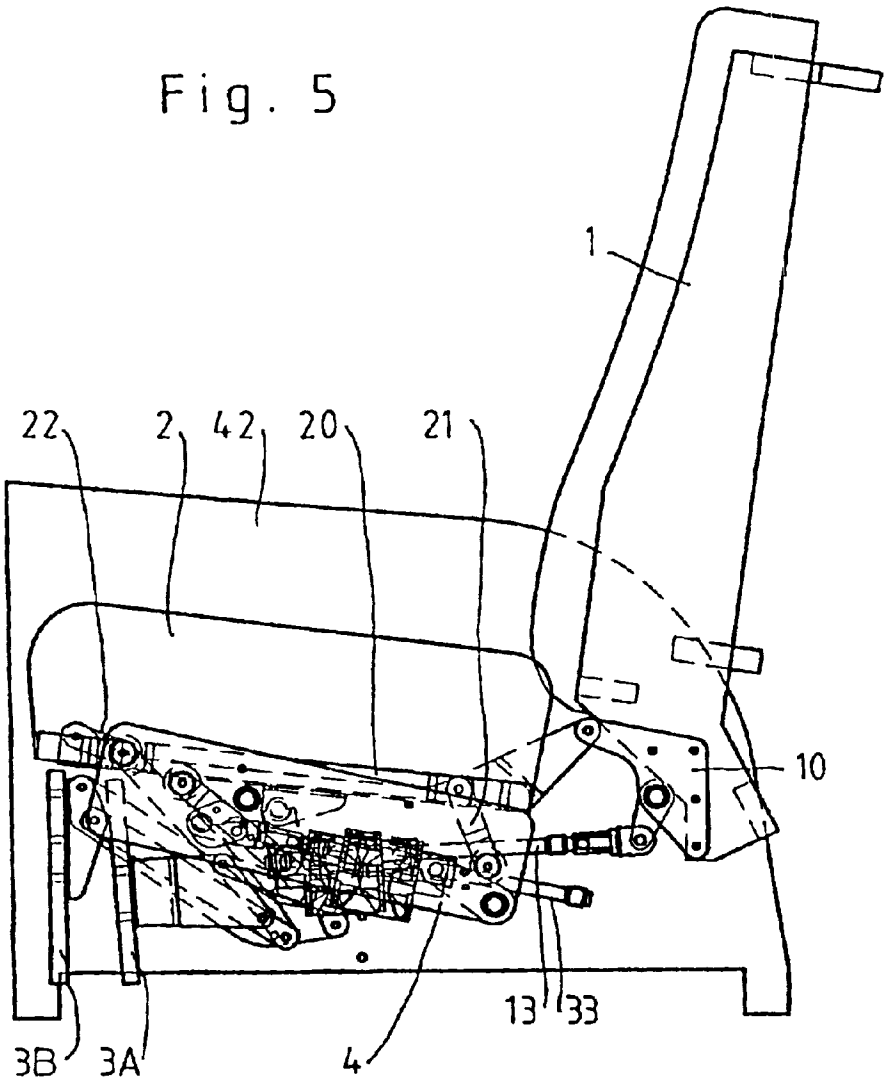
FIG. 5 is an assembled longitudinal view of a portion of a fuel injector according to an alternative embodiment of the present invention, showing the third and fourth cylindrical members of the embodiment depicted in FIG. 1 formed as one piece.

In front of the seat surface, on a somewhat lower level, the surfaces of two leg supports 3A, 3B extend flush with one another and are linked on both sides to leg support fitting linkage arms 34–38,in each case via angle pieces 30A, 30B to which they are screwed, with the leg support fitting linkage arm consisting of an auxiliary linkage arm 38 and scissor-type linkage mechanism 34–37, which is linked at its other end to the lateral plate 4. The scissor-type linkage mechanism 34–38 has relatively long levers that extend approximately from the seat to the floor when the scissor-type linkage joint passes approximately through its lowest point during a pivoting process, as can be derived from FIGS. 3 and 5, which show an intermediate position and the retracted position of the leg supports 3A, 3B.

The front leg support 3B in its retracted position is positioned vertically and extends at its top to within a close distance underneath the frame of the seat 2 with a small clearance and at its bottom to a few centimeters above the floor. In the cross direction it closes the entire front region between the chair side panels 42, as shown in FIG. 2, with a small clearance on the sides.

The rear leg support 3A in its folded-in position is located approximately parallel to the front leg support at a distance from the same to leave space for the padding. The lateral extension of the rear leg support 3A is somewhat smaller than that of the front leg support, as shown in FIG. 2, to leave space on the sides for the scissor-type linkage and the flange of the angle pieces 30A, 30B.

To permit the rear leg support 3A to swivel from its vertical position into the approximately horizontal supporting position according to FIG. 1 when the scissor-type linkage mechanisms are actuated, the downward pointing leg of the angle piece 30A is linked both to a front scissor-type linkage arm 36 and also with an auxiliary linkage 38 to a rear scissor-type linkage arm 35. The view of the leg support fitting linkages 34–38 in FIG. 1 corresponds to a view I—I from the center of FIG. 2 onto the above-drawn fitting.

As shown by FIG. 2, the rear scissor-type linkage arms 34, 35 are disposed above one another close to the lateral plate 4 and the front scissor-type linkage arms 36, 37 are disposed to the right and left of the them. This narrow design of the scissor-type linkage mechanism prevents the occurrence of twisting moments.

The outer front scissor-type linkage arm 37 is approximately twice as wide as the others. It thus has a much higher section modulus and no gap forms between the front scissor-type linkage arms in any readjustment position of a size that would allow a finger to get caught. The rear scissor-type linkage arms 34, 35 are spaced far enough apart even in their closest position, which is shown in FIG. 1, so that fingers can be placed between them and there is no danger of them getting caught.

Figure 6:
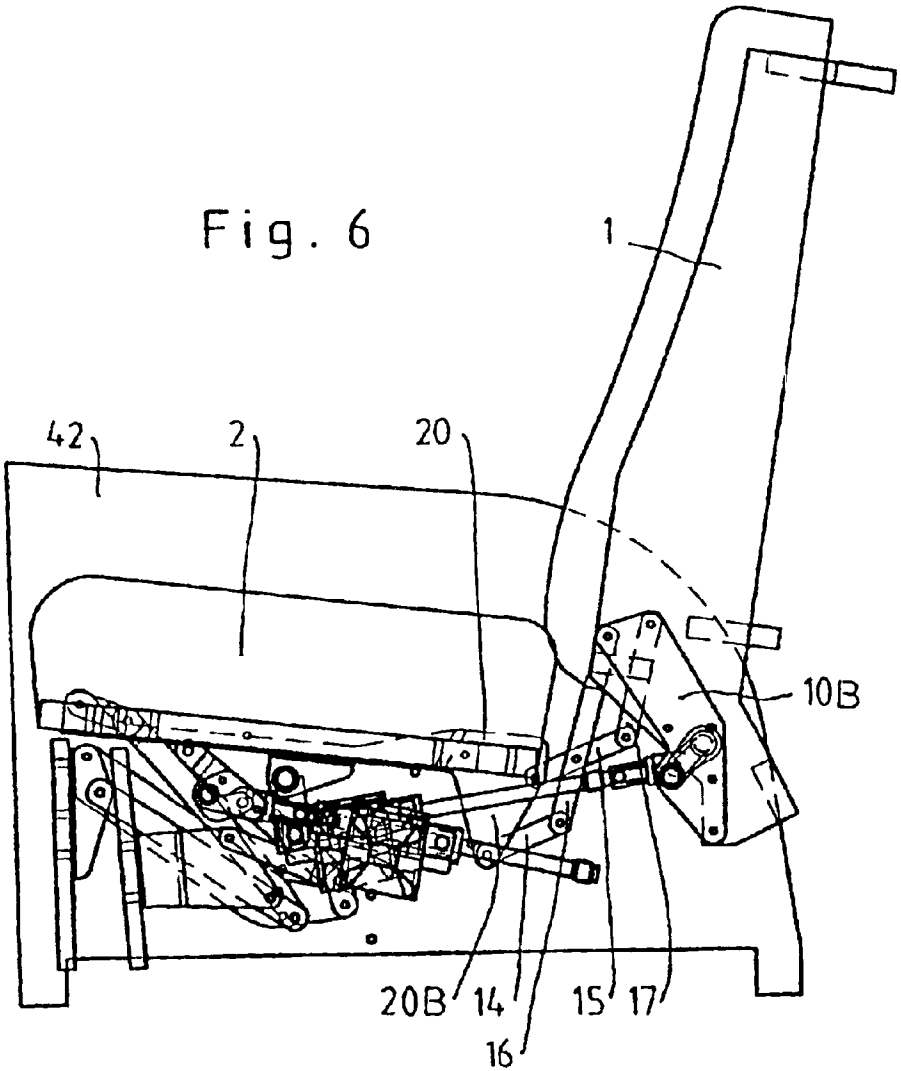
FIG. 6 shows a backrest with scissor-type linkage in the sitting position.
Figure 7:
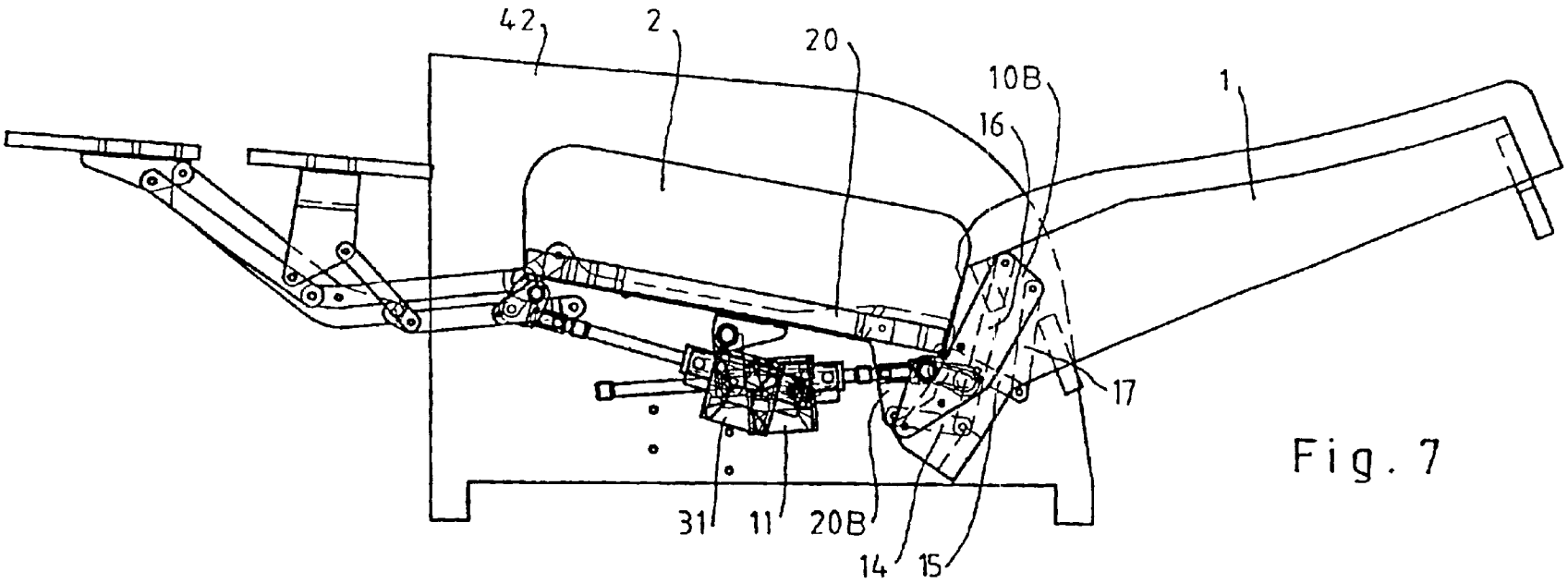
Fig. 7 shows a reclined position for the chair in FIG. 6, partially in the view VII—VII.
Figure 8:
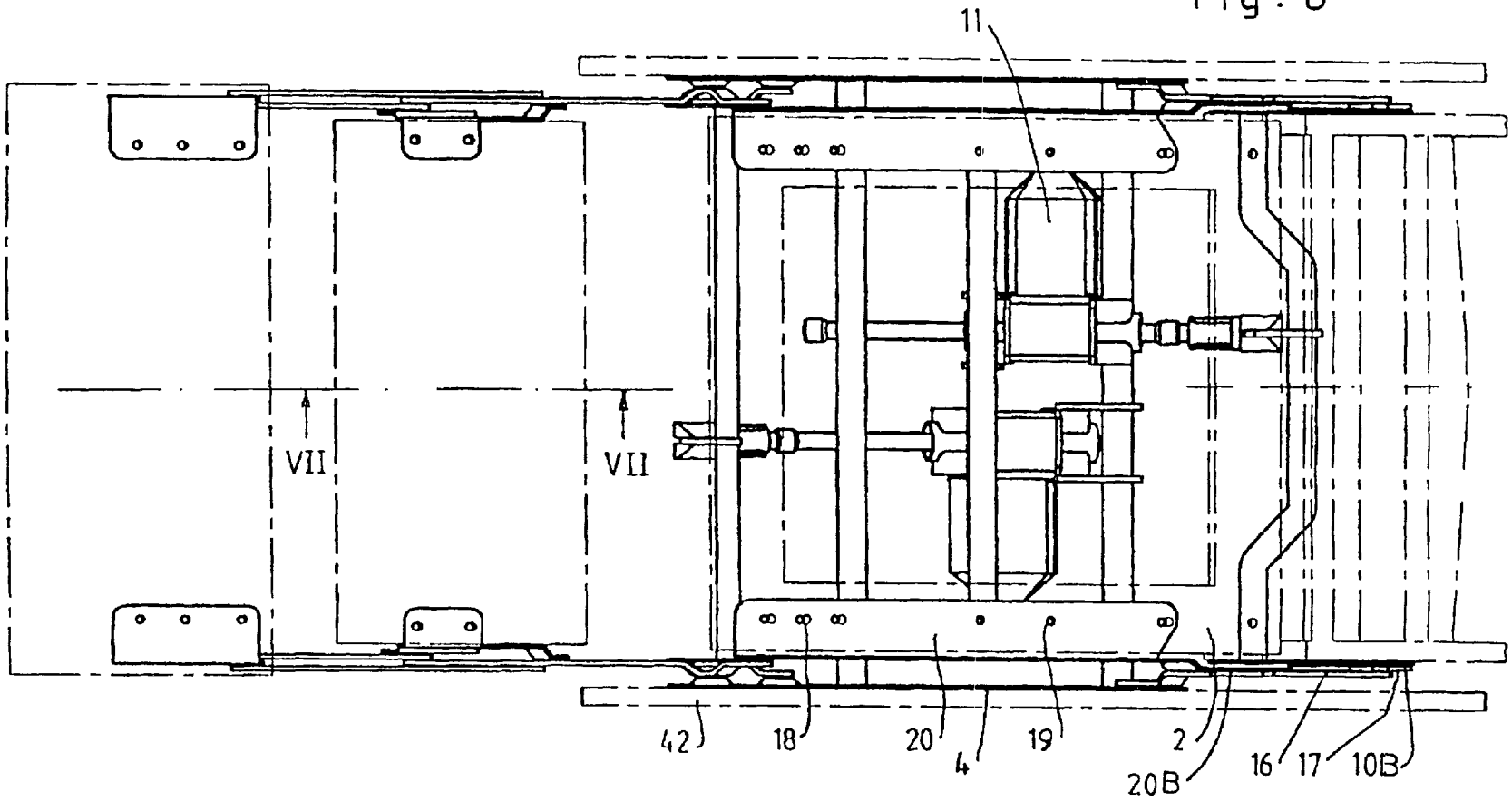
FIG. 8 shows a top view on the fitting in FIG. 7.

FIGS. 6 through 8 show a second embodiment of the backrest coupling that takes place via scissor-type linkage gears 14–17. The projections in FIGS. 6 and 7 are derived from the section VI—VI; the lateral plates and the rear seat linkage arm are not shown for ease of viewing.

FIG. 6 shows the backrest 1 in the upright position and FIG. 7 shows it in the completely reclined position. The padding of the backrest 1 and seat 2 are in contact in all positions, no interfering gap is formed into which loose padding elements or pieces of clothing could be drawn or become wedged.

The seat fitting 20 has a downward facing mounting angle extension 20B to which the scissor-type linkage arms 14, 15 closest to the seat are linked at a distance above one another offset behind one another. The scissor-type linkage arms 16, 17 closest to the backrest are directed upward and linked to the former on one hand and linked, spaced apart above and behind one another, to a mounting plate 10B and connected via the same with the backrest 1 to its frame.

As shown in FIG. 8, the backrest cross bar 20B, to which the backrest adjusting motor 11 is connected, is shaped with an offset bend. The backrest cross bar 20B extends between mounting plates 10B. These as well as all backrest drive elements and the scissor-type backrest linkage gears are situated under the seat padding and backrest padding in all positions of the backrest, and on the sides these padding elements extend close to the chair side panels.

Figure 9:
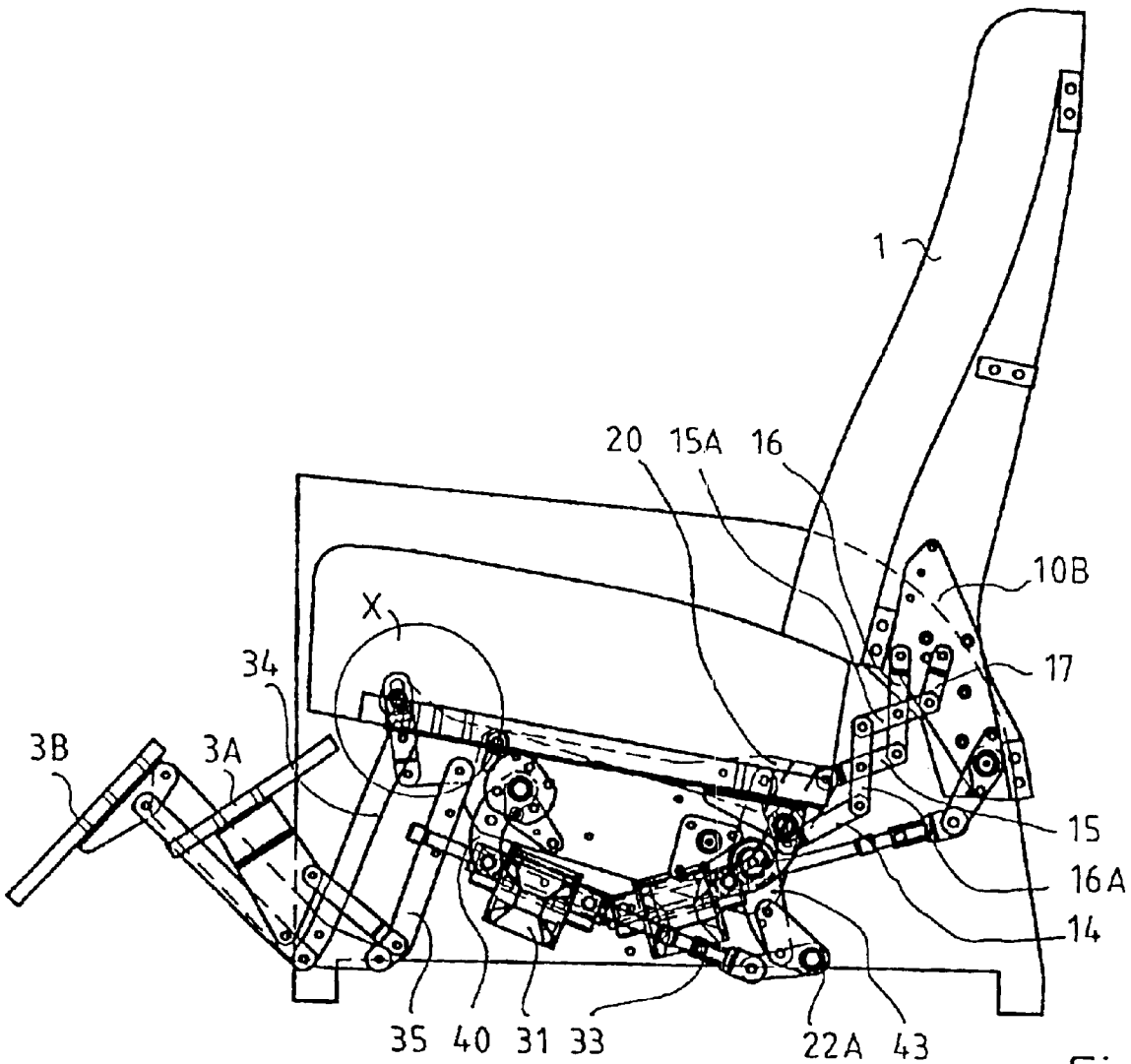
FIG. 9 shows a chair similar to FIG. 6 and 7, in an intermediate position with a multi-part scissor-type linkage mechanism to link to the backrest, and a different position of the leg support drive.

FIG. 9 shows a chair in a further exemplary embodiment of the scissor-type backrest linkages 14–17 and leg support drive 31, 33. The scissor-type backrest linkage arms 14, 15, 16, 17, together with additional scissor-type backrest linkage arms 15A, 16A, form a multi-step scissor-type linkage mechanism in the style of lazy tongs. The backrest 1 is shown in its upright position.

The scissor-type linkage arm 15 closest to the seat is connected pivoting to the scissor-type linkage arm 16 closest to the backrest, and the scissor-type linkage arm 14 is connected via two additional scissor-type linkage arms 16A and 15A to the scissor-type linkage arm 17 closest to the backrest. In this embodiment the scissor-type linkage arm 16 closest to the backrest is situated at a distance from the scissor-type linkage arm 17 closest to the backrest. This results in an advantageous option to adapt the movement of the backrests to different frames so that the padding elements of the backrest 1 and seat 2 are again advantageously in contact in any position in such a way that no gap occurs.

The motor 31 of the leg support adjusting drive is linked to the cross-member 40, its leg support adjusting spindle 33 is connected pivoting to a cross bar 22A. The cross bar 22A is situated between two pivoting levers 43 and connected to the same. The pivoting levers 43 are pivot mounted on the two lateral plates 4 and connected pivoting at their upper ends to the mounting angles 20. During a readjustment of the leg support adjusting spindle 33, for example in the direction toward the foot end, this direction of movement is reversed by the pivoting levers 43 so that the mounting angles 20 move in the opposite direction. In the front area of the mounting angles 20 the leg support fitting linkages 34 are linked in a coupled fashion and, in the process, extend the leg supports 3A, 3B. The leg supports 3A, 3B are thus adjusted indirectly via the movement of the mounting angles 20. It is advantageous in this context that the cross bar 32 is eliminated and more space is created to retract the leg supports 3A, 3B.

FIG. 10 shows, in an enlarged section of the area X according to FIG. 9, the coupling of the mounting angle 20 to the leg support fitting linkage arm 34 via a pin 44. The leg support fitting linkage arm 34 has, for this purpose, an angled extension with a slotted hole 34B, which is connected to the pin 44 and, hence, to the mounting angle 20. It is particularly advantageous to use a slotted hole since significantly lesser drive forces are thus required to adjust the leg supports.

FIG. 11 shows a view of the section A—A in FIG. 10. The slotted hole 34B is provided with a low-friction design, for example in the form of a sleeve 34C. In this sleeve 34C, the pin 44, which also has a sleeve 34, is guided in a low-friction manner. The material for the sleeves 34C, 34D is preferably plastic.

In an advantageous arrangement, the seat fitting linkage arms 34A, leg support fitting linkage arms 34, and mounting angle 20 are connected in a linking point by means of the pins 44 so that they are pivotable in relation to one another.

Figure 12:
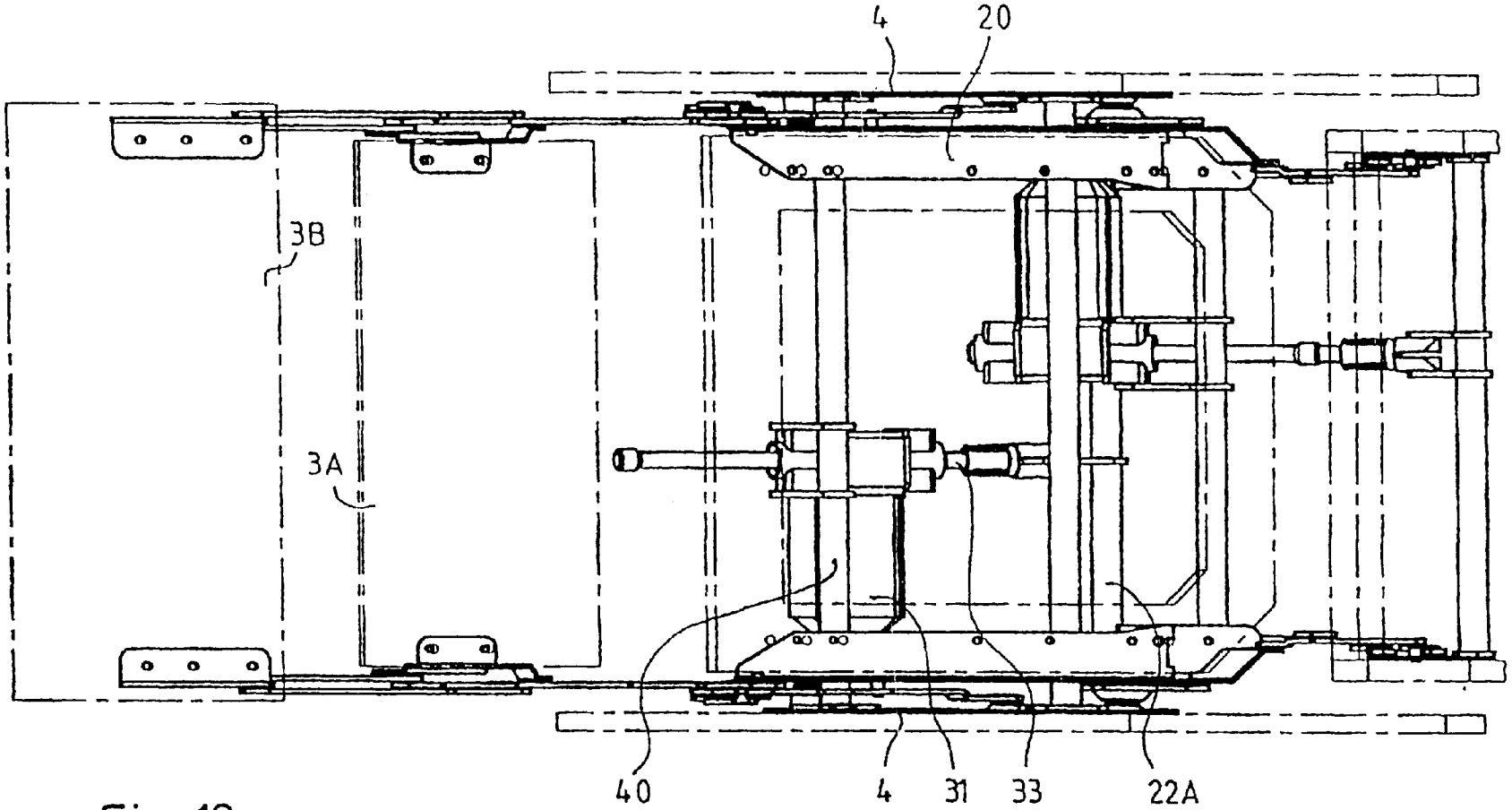
FIG. 12 shows a top view of the fitting in FIG. 9.

FIG. 12 shows a top view of the fitting according to FIG. 9.

To facilitate the installation of the seat frame 2 on the mounting angle 20, a plurality of centering pins 18 and additional round screw holes 19 are provided in the same. The seat frame can thus be inserted with the centering pins (18) into matching centering holes and held in position while the securing screws are screwed in through the screw holes 19.

The backrest frame and side panels are pre-drilled with templates or provided with bolts or threaded inserts so that the backrest and lateral plates can easily be screwed together there in an accurate position.

To facilitate the installation of the seat frame 2 and/or seat side panels 42, the mounting angles and/or lateral plates 4 are preferably entered into the centering pins 18, causing them to be received in matching bores and held centered and in the correct position.

List of Reference Numerals

1 Backrest (Backrest Frame)
2 Seat (Seat Frame)
3 Leg Supports
3A Leg Supports
3B Leg Supports
4 Lateral Plates
10 Mounting Plate
10B Mounting Plate-with Scissor-Type Linkage Joint
11 Motor for 1
12 Backrest Cross Bar for 11/1
12B Backrest Cross Bar with an Offset Bend on the Scissor-Type Linkage Joint
13 Adjusting Spindle in 11 (Drive Member)
14 Backrest Scissor-Type Arms
15, 15A Backrest Scissor-Type Arms
16, 16A Backrest Scissor-Type Arms
17 Backrest Scissor-Type Arms
18 Centering Pins
19 Screw Holes
20 Mounting Angle for 2
20A Mounting Angle Extension
20B Mounting Angle Extension for Scissor-Type Linkage Joints
22 Seat Cross Bar
22A Cross Bar
23 Backrest Linkage Joint
24 Seat Fitting Linkage Arm, Rear
30 Angle Piece
30A Angle Piece for 3A
30B Angle Piece for 3B
31 Motor for 3A, 3B
32 Cross Bar for 31
33 Leg Support Adjusting Spindle in 31 (Drive Member)
34 Leg Support Fitting Linkage Arm, Rear
34A Seat Fitting Linkage Arm, Front
34B Slotted Hole
34C Sleeve
34D Sleeve
35 Leg Support Fitting Linkage Arm—Scissor-Type Linkage Arm
36 Leg Support Fitting Linkage Arm—Front Side
37 Scissor-Type Linkage Arm
38 Auxiliary Linkage Arm
40 Cross-members between 4
41 Cross-members between 4
42 Chair Side Panel with Armrest
43 Pivoting Lever
44 Pin

What is claimed is:

1. A seat recliner fitting comprising a motor-driven inclination adjustment of a backrest frame (1) and for the motor-driven folding out and folding in of a leg support having two leg support components (3A, 3B), wherein the fitting is completely preinstalled at the factory between two lateral plates (4), which are connected to cross-members (40, 41), a respective side panel (42) provided with an arm rest is attached to each of said cross-members, each of said lateral plates (4) has seat fitting linkage arms (24, 34A) linked thereon, to which a pair of mounting angles (20) are linked to attach a seat frame (2), which extends along the length of the angles, and the leg support components (3A, 3B) are linked by scissor-shaped leg support linkage arms (34–37) as support fitting linkage arms, which carry the leg supports (3A, 3B) on respective angle pieces (30A, 30B) and a pair of mounting plates (10, 10B) to hold the backrest frame (1) are linked to the mounting angles (20), and that a backrest cross bar (12, 12B) is disposed between the mounting angles (20) on both sides, and a pair of drive members (13,33) each belonging to one of a pair of adjusting motors (11,31), a first motor (11) of said adjusting motors being the backrest adjusting motor (11), and the drive member (13) thereof extending between a first cross-member (40) to the backrest cross bar (12) and a second motor (31) of said adjusting motors being a leg support drive motor (31), and the drive member (33) thereof extending from a second cross-member (41) to the scissor-shaped cross-bar (32) that extends between two scissor-shaped linkage arms (34,35).

2. The seat recliner fitting according to claim 1, characterized in that an integral mounting angle extension (20B) is provided on the mounting angles (20) of the seat (2) in each case, which extends above the seat (2) in the rear and approximately to half its height, to the end section of which the mounting plate (10) of the backrest (1) is linked.

3. The seat recliner fitting according to claim 1, characterized in that an integral mounting angle extension (20B) is provided in each case on the mounting angles (20) of the seat (2), said mounting angle extension extending downwardly along the rear seat area and having linked to it a scissor-shaped backrest linkage arm (14–17) and extending upwardly toward the rear, where it is linked to a mounting plate (10B), which is fastened to the backrest (1).

4. The seat recliner fitting according to claim 3, characterized in that the backrest cross bar (12B) extends between the mounting plates (10B), shaped with an offset bend toward the rear.

5. The seat recliner fitting according to claim 3, characterized in that the scissor-shaped backrest linkage arms (14–17) are disposed and executed such that the padding of the backrest (1) and seat (2) are in contact with one another in each inclined position of the backrest and the scissor-type backrest linkage arms (14–17) and the mounting plate (10B) are covered by the padding elements.

6. The seat recliner fitting according to claim 1, characterized in that the drive members (13, 33) of the motors (11, 31) are adjusting spindles.

7. The seat recliner fitting according to claim 1, characterized in that the scissor-shaped leg support linkage arms (34–37) in their folded-in position extend from the front seat area nearly to the floor and the leg supports (3A, 3B) are disposed spaced apart behind one another so that the front leg support (3B) almost completely closes off a front region below the seat (2).

8. The seat recliner fitting according to claim 7, characterized in that the scissor-shaped leg support linkage arms (34–37) in said completely folded-out position each hold the front angle piece (30B) in front of the seat (2) in such a way that the front leg support (3B) is situated slightly tilted relative to the seat surface, slightly lower than the seat surface, and that the angle piece (30A) closest to the seat is linked by one side leg to the lower front scissor shaped linkage arm (36) and by an auxiliary linkage (38) to the lower scissor-shaped linkage arm (35) closest to the seat, so that, in its fully extended position, the leg support closest to the seat that is mounted on the angle pieces (30A) is flush with the front leg support (3B).

9. The seat recliner fitting according to claim 8, characterized in that the scissor-shaped leg support linkage arms (34–35) closest to the seat are disposed above one another and the front scissor-type leg support linkage arms (36, 37) are disposed to both sides of the support linkage arms in the rear.

10. The seat recliner fitting according to claim 8, characterized in the scissor-shaped leg support linkage arms (34, 35) closest to the seat are disposed such that they have a minimum clearance of one finger's width.

11. The seat recliner fitting according to claim 8, characterized in that the front scissor-shaped leg support linkage arm (37) that is located on the outside of one of the angle pieces (30A) is wide enough to overlap the scissor-shaped leg support linkage arm (36) that is located on the inside of one of the angle pieces (30A).

12. The seat recliner fitting according to claim 8, characterized in that the upper support linkage (34) closest to the seat extends beyond the lateral plate (4) to form the front seat fitting linkage arm (34A) and on to the linkage joint on the mounting angle (20), and which is formed shorter than the rear seat fitting linkage arm (24) and relative thereto in such a way that when the leg supports (3A, 3B) are extended, the seat frame (2) is situated lower towards the front and further back than when the leg supports (3A, 3B) are retracted and the rear portion of the seat frame (2) is always at approximately the same height when the seat frame is moved back and forth when the leg support is being adjusted.

13. The seat recliner fitting according to claim 1, characterized in that the cross bar (22A) is positioned between the mounting angles (20) on downward facing mounting extensions of the mounting angles (20) or on pivoting levers (43) that are pivot-mounted on the lateral plates (4).

14. The seat recliner fitting according to claim 13, characterized in that the leg support fitting linkage arms (34) are additionally pivot-mounted to the mounting angles (20).

15. The seat recliner fitting according to claim 14, characterized in that the leg support fitting linkage arms (34) are pivot-mounted to the mounting angles (20) in the linking points of the seat fitting linkage arms (34A).

16. The seat recliner fitting according to claim 14, characterized in that the leg support fitting linkage arms (34) have slotted holes (34B) in the linking points on the mounting angles (20).

17. The seat recliner fitting according to claim 16, characterized in that the slotted holes (34B) of the leg support fitting linkage arms (34) have a low-friction design.

18. The seat recliner fitting according to claim 17, characterized in that the slotted holes (34B) have plastic sleeves (34C) and the pin (44) that is guided inside these sleeves (34C) is provided with an appropriate plastic sleeve (34D).

19. The seat recliner fitting according to claim 1, characterized in that the scissor-shaped backrest linkage arms (14–17) form a multi-part scissor-shaped linkage mechanism in the style of lazy tongs.

20. The seat recliner fitting according to claim 1, characterized in that the mounting angles (20) have centering pins (18) and screw holes (19), and that the seat frame (2) or the side panel (42) are held and screwed in position aligned in matching centering bores.

21. The seat recliner fitting according to claim 1, characterized in that the cross bars (12, 22, 22A, 32) and the cross-members (40, 41) are tubular members that are held in borings and connected releasable or rigidly.

* * * * *